US007086298B1

(12) United States Patent
Colman

(10) Patent No.: US 7,086,298 B1
(45) Date of Patent: Aug. 8, 2006

(54) APPARATUS AND METHOD FOR IDENTIFYING BOWSTRING FORCE CHARACTERISTICS

(76) Inventor: Ronin Borg Colman, P.O. Box 535025, Grand Prairie, TX (US) 75053

( * ) Notice: Subject to any disclaimer, the term of this patent is extended or adjusted under 35 U.S.C. 154(b) by 121 days.

(21) Appl. No.: 10/921,446

(22) Filed: Aug. 19, 2004

(51) Int. Cl.
*G01D 9/00* (2006.01)

(52) U.S. Cl. ..... 73/862.51

(58) Field of Classification Search ..... None
See application file for complete search history.

(56) References Cited

U.S. PATENT DOCUMENTS

| | | | | |
|---|---|---|---|---|
| 2,763,156 | A * | 9/1956 | Garigal | 73/379.08 |
| 4,134,383 | A | 1/1979 | Flood | |
| 4,368,719 | A | 1/1983 | Christopher | |
| 4,454,858 | A | 6/1984 | Henry | |
| 5,090,395 | A | 2/1992 | Gannon | |
| 5,779,577 | A | 7/1998 | Erickson | |
| 5,954,041 | A | 9/1999 | Sands | |
| 6,213,113 | B1 * | 4/2001 | Groover et al. | 124/86 |
| 6,220,235 | B1 | 4/2001 | Sands | |

OTHER PUBLICATIONS

Archery Manufactures and Merchants Organization, "Standard Test Method for Determining the Force-Draw and Let-Down Curves for Archery Bows", ASTM International Committee F08, Nov. 10, 1997, pp. 1-3, Designation: F 1832-97, ASTM International, Pennsylvania. (Reapproved 2002).

Archery Manufactures and Merchants Organization, "Standard Test Method for the Determination of Percent of Let-Off for Archery Bows", ASTM International Committee F08, May 1, 2004, pp. 1-3, Designation F 1880-98 (reapproved 2004) , ASTM International, Pennsylvania.

* cited by examiner

*Primary Examiner*—Edward Lefkowitz
*Assistant Examiner*—Octavia Davis
(74) *Attorney, Agent, or Firm*—Russell D. Culbertson; The Culbertson Group, P.C.

(57)

ABSTRACT

An apparatus includes a base structure, a force measuring device, and a processing device. The force measuring device is operatively connected between a bowstring connector and a force transmitting connection to the base structure, and is adapted to produce a force output signal indicative of the tensile force applied along a draw force axis between the bowstring connector and the base structure. The processing device is mounted on the base structure and uses the force output signal received from the force measuring device to identify one or more bowstring force characteristics from the force output signal produced over the course of the bowstring draw cycle.

20 Claims, 5 Drawing Sheets

APPARATUS AND METHOD FOR IDENTIFYING BOWSTRING FORCE CHARACTERISTICS

TECHNICAL FIELD OF THE INVENTION

The present invention relates to archery and to archery accessories. More particularly, the invention relates to an apparatus and method that an archer may use to determine certain critical bowstring force characteristics or to map the force applied by the bowstring over the course of a bowstring draw cycle.

BACKGROUND OF THE INVENTION

One of the most significant developments in the field of archery has been the development of precision arrow shafts in which the degree of flex can be held to a close tolerance known as "spline." With the advent of such precision arrows, it is now possible to match a given bow to a particular precision arrow to optimize accuracy and performance. This is particularly important in modern compound bows in which the amount of force applied by the bowstring varies with the position of the bowstring with respect to the bow.

In order to correctly select an arrow for a specific bow, it is necessary to determine the amount and rate of energy transfer from the bowstring to the arrow. This has been done using charts developed for the purpose, such as the Easton® Shaft Selection Charts. Using these charts, the archer chooses from among a coarse selection of bow cams which the archer estimates most closely corresponds to his or her bow. The archer then goes on to answer specific questions about his bow, and the respective chart will ultimately lead him to a general arrow selection. These chart-based arrow selection systems have also been automated in the form of computer programs such as the Easton® Shaft Selector system and the Archer's Advantage™ program. In all cases, an attempt is made to estimate a force-draw curve of the bow in order to select an optimum arrow. The force-draw curve comprises a plot of the force applied by the bowstring as the bowstring is drawn from an initial relaxed position to the maximum bowstring displacement. More particularly, the force-draw curve is defined by the Archery Manufacturers and Merchants Organization to be the curve that is plotted using the force readings, taken at incremental values of draw length when drawing the bow, as the ordinate and the corresponding draw length as abscissa.

Ideally, one would prefer to actually measure the force-draw curve of the bow, as opposed to estimating it. Knowing the force-draw curve of the bow allows a more refined arrow selection than is possible with a chart-based estimating system. Standards for determining the force-draw curve of a bow are set in the document entitled "Standard Test Method for Determining the Force-Draw and Let-Down Curves for Archery Bows" Designation: F 1832-97 (reapproved 2002) published by ASTM International. This publication also sets a standard for determining the "let-down curve" of a bow. The let-down curve is defined as the curve that is plotted using the force readings, taken at incremental values of draw length when relaxing the bow, as the ordinate and the corresponding draw length as abscissa. The entire content of this publication is hereby incorporated herein by this reference.

U.S. Pat. No. 6,220,235 shows a device that may be used to create the actual force-draw curve for a bow. In the device shown in this patent, the bow is attached to a fixture and a force measuring device is attached between the bowstring and a pulley system by which the bowstring may be drawn. The fixture also includes a scale that may be used to measure the displacement of the bowstring in the course of drawing the bowstring to a maximum displacement using the pulley system, and then returning the bowstring to the relaxed position. By combining the force reading from the force measuring device with the bowstring position data, both the actual draw-force curve and the actual let-down curve for the bow may be plotted.

Although it is possible to plot the actual draw-force curve and let-down curve for a bow using the device shown in U.S. Pat. No. 6,220,235, the device required to collect the data is cumbersome and mechanically complex. Many archers do not have access to such a fixture-based device and thus opt for the less accurate chart-based arrow selection in lieu of selection based on the actual force characteristics of their bow and bowstring.

SUMMARY OF THE INVENTION

The present invention provides both methods and apparatus for plotting the draw-force curve and let-down curve for a bow and/or determining critical bowstring force characteristics. An apparatus according to one aspect of the invention includes a base structure, a force measuring device, and a processing device. The force measuring device is operatively connected between a bowstring connector and a force transmitting connection to the base structure, and is adapted to produce a force output signal indicative of the tensile force applied along a draw force axis between the bowstring connector and the force transmitting connection to the base structure. The processing device is mounted on the base structure and uses the force output signal received from the force measuring device to identify one or more bowstring force characteristics from the force output signal produced over the course of the bowstring draw cycle, that is, over the course of bowstring displacement from a relaxed position, to full draw, and back to the relaxed position.

In another form of the invention a displacement detecting device is also mounted on the base structure along with the force measuring device. This displacement detecting device is adapted to connect to the bow and produce a bowstring displacement output signal as the base structure is moved with respect to the bow in the course of a bowstring draw cycle. In this form of the invention the processing device does not necessarily identify one or more bowstring force characteristics. Rather, the processing device in this alternate arrangement receives the force output signal and bowstring displacement output signal, and maintains both a record of the tensile force applied along the draw force axis and a record of bowstring displacement over the bowstring draw cycle. The force-draw curve and let-down curve, along with certain critical bowstring force characteristics may be determined from these records.

It will be appreciated that since the force measuring device and bowstring displacement measuring device (in embodiments that use such a displacement measuring device) are both located on the common base structure, the apparatus according to the present invention may dispense with the cumbersome bow fixtures used in prior draw-force curve and let-down curve mapping devices. The present device for determining critical bowstring force characteristics may therefore comprise a small, hand-held device that is suitable for use by substantially any archer both at home, or in the field, or at a competition. Embodiments of the present invention that employ only the force measuring device without the bowstring displacement measuring arrangement may produce readings on critical bowstring force characteristics such as peak pull weight, let-off, and percent let-off as will be described in further detail in the following description with reference to the drawings.

A method according to one form of the invention includes connecting the base structure to a bow's bowstring through the force measuring device and moving the base structure with respect to the bow to displace the bowstring through the bowstring draw cycle. This method further includes detecting the force applied between the base structure at least periodically over the course of displacing the bowstring through the bowstring draw cycle, and identifying one or more bowstring force characteristics such as peak pull weight and/or let-off from the detected force applied between the base structure and the bowstring over the course of the bowstring draw cycle.

An alternate method according to the present invention includes connecting the base structure to the bow through the displacement measuring device in addition to connecting a base structure to the bowstring through the force measuring device. This alternate form of the invention further includes maintaining a record of the force applied between the base structure and the bowstring and maintaining a record of bowstring displacement over the course of the bowstring draw cycle.

These and other advantages and features of the invention will be apparent from the following description of preferred embodiments, considered along with the accompanying drawings.

DESCRIPTION OF PREFERRED EMBODIMENTS

The claims at the end of this application set out novel features which the Applicant believes are characteristic of the invention. The various advantages and features of the invention together with preferred modes of use of the invention will best be understood by reference to the following description of illustrative embodiments read in conjunction with the drawings introduced above.

Figure 1:
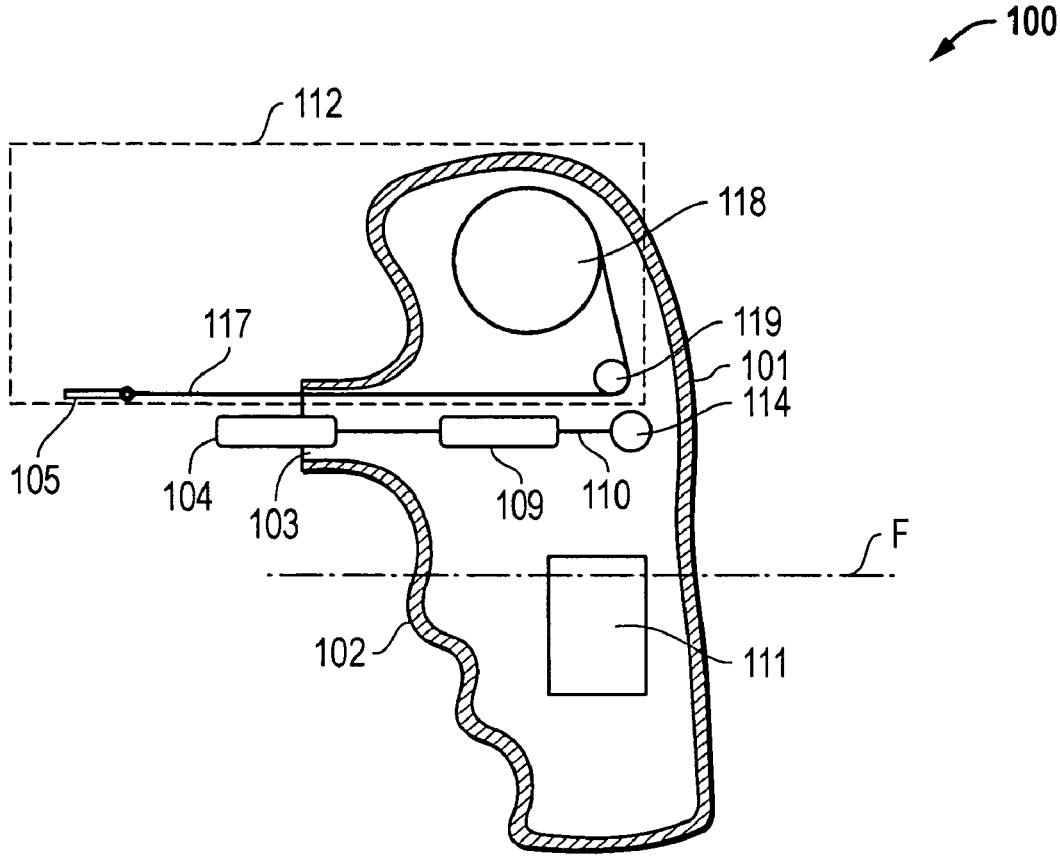
FIG. 1 is a partially diagrammatic section view of one preferred device according to the present invention.

FIG. 1 shows a device 100 according to one preferred form of the invention. This preferred form includes a housing 101 which is preferably ergonomically shaped with a front and adjacent side outer surface 102 that allows the housing to be comfortably grasped by a user with one hand and pulled back along axis F to the right in the figure. A connector outlet structure 103 at the front of housing 101 allows a bowstring connector 104 and bow connector 105 to extend from the housing. Housing 101 forms a base structure upon which is mounted a force measuring device, which, in this form of the invention, includes a strain gauge 109 mounted in a force transmission element 110. Housing 101 also preferably contains a processing device 111 which will be described in further detail below with reference to FIG. 4 together with other electronic components of device 100. Housing 101 also provides a base structure for supporting a bowstring displacement measuring device shown generally at reference numeral 112.

The force measuring device made up of strain gauge 109 and force transmission element 110 is connected between bowstring connector 104 and a force transmission connection 114. In preferred forms of the invention force transmission connection 114 comprises a pivot connection that allows the force transmission element 110 and strain gauge 109 to pivot somewhat with respect to housing 101 to help ensure that the force being detected by the strain gauge represents the entire pull force. It will be appreciated that force measuring elements other than a strain gauge may be used to produce a force output signal that may be used according to the present invention and that numerous different structures may be used to apply the bowstring force to the measuring element. Regardless of the specific structure of the force measuring device and the particular type of force measuring element included in the force measuring device, the force measuring device according to the invention provides a force output signal that is indicative of the tensile force applied along a draw force axis between bowstring connector 104 and the base structure, in this case housing 101. Processing device 111, which will be discussed further below with reference to FIG. 4, receives this force output signal and uses the force output signal to identify one or more bowstring force characteristics such as peak pull weight or maximum let-off, and/or to maintain a record of bowstring force over the course of the bowstring draw cycle.

The displacement detecting device shown in box 112 includes bow connector 105 and a length of line 117 having an opposite end wound on a spring-loaded storage reel 118. The displacement detecting device further includes a rotational encoding wheel (encoder) 119 that is adapted to cooperate with line 117 to provide a bowstring displacement output signal as the base structure/housing 101 is moved with respect to the bow in the course of a bowstring draw cycle. The preferred encoder 119 produces a displacement output signal made up of a series of pulses created as the encoder turns. The output signal preferably indicates both rotational angular displacement and direction of rotation. Processor 111 may receive this displacement output signal and use the signal to maintain a record of bowstring displacement over the course of the bowstring draw cycle. This record of bowstring displacement may be used in the form of the invention shown in FIG. 1 together with the bowstring force measurements to produce the actual force-draw curve for the bow and the let-down curve. These plots of bowstring force may be used for various purposes. In particular, the force-draw curve may be used in selecting an optimum arrow shaft for the particular bow and bowstring combination. The let-down curve may be used in maintaining and tuning the bow and in analyzing the hysteresis of the bow.

Figure 2:
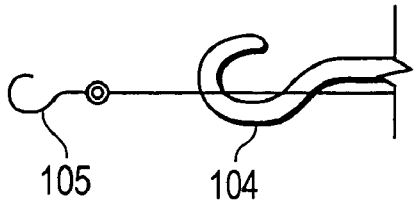
FIG. 2 is a representation of the bowstring connector and bow connector shown in FIG. 1.

FIG. 2 shows the bowstring connector 104 and bow connector 105 from a different perspective. From this perspective, it is apparent that bow connector 104 comprises a hook structure that may be hooked over a bowstring. The illustrated bow connector also includes a hook. However, this hook is used to secure line 117 to the bow as will be described further below with reference to FIGS. 5 and 6.

Figure 3:
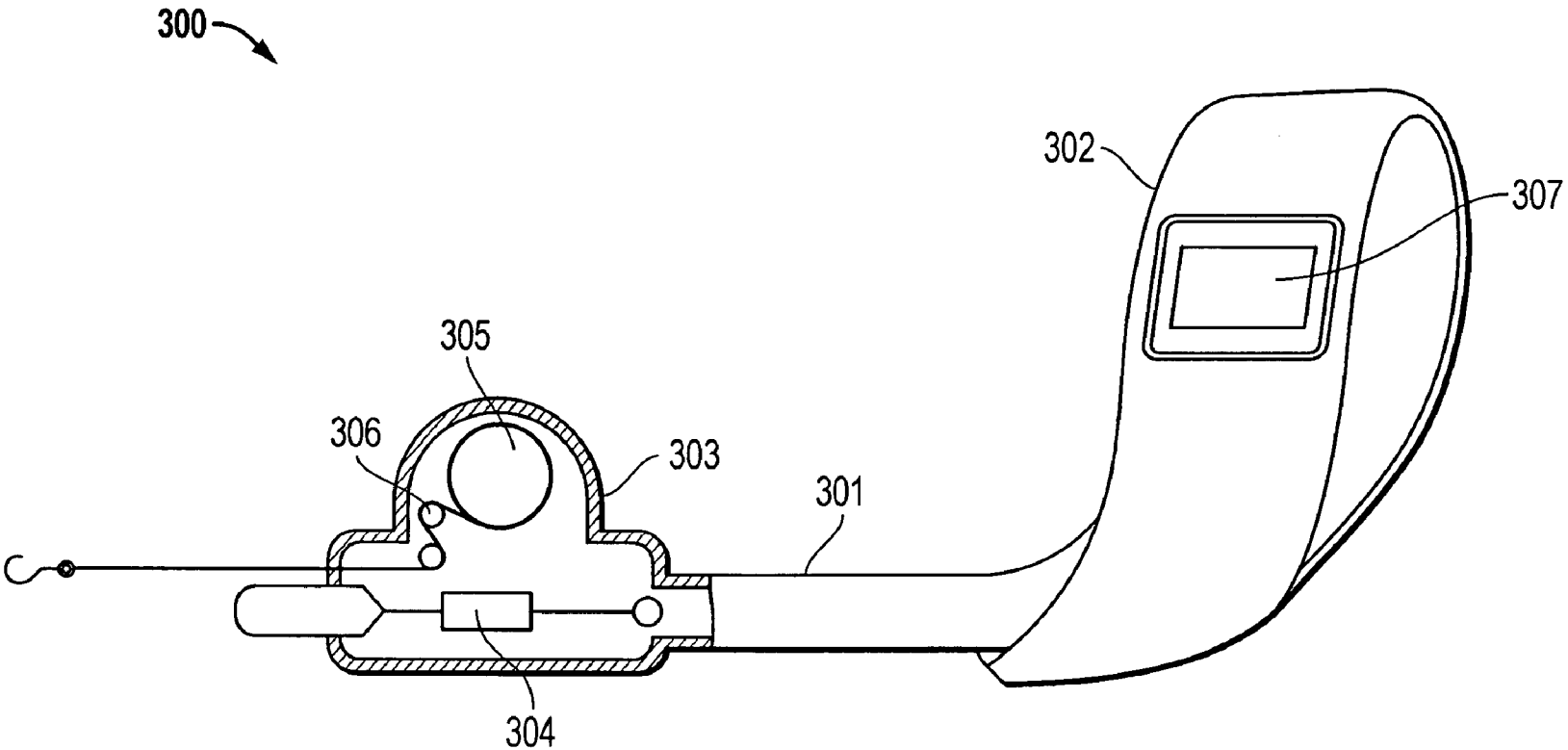
FIG. 3 is a partially diagrammatic partial section view of an alternate preferred form of device according to the present invention.

FIG. 3 shows an alternate device 300 within the scope of the present invention. Device 300 includes an alternate base structure including an elongated member 301 connected to a wrist strap 302. A housing 303 at one end of elongated member 301 houses a force detecting arrangement including a strain gauge 304 similar to strain gauge 109 shown in FIG. 1. Housing 303 also encloses a bowstring displacement detecting arrangement including a spring-loaded reel 305 and rotational encoding wheel 306 similar to arrangement 112 shown in FIG. 1. FIG. 3 also shows a display 307 mounted on wrist strap 302.

It will be appreciated that both FIGS. 1 and 3 are generally diagrammatic in that they do not show the actual structure used to secure the various elements in the respective housing 101 or 303. Rather, these drawings merely indicate that the various elements, and particularly the bowstring force measuring arrangement and bowstring displacement measuring arrangement, are mounted on the respective housing/base structure. It will be appreciated that these components may be mounted on the respective housing/base structure in any suitable manner and in any suitable location to perform the desired functions. Also, many variations are possible in the form of housing/base structure. The vertical hand grip-type device 100 shown in FIG. 1 and the wrist strap-type device 300 shown in FIG. 3 are shown only for purposes of example and the invention is by no means limited to these specific structures or arrangements of components. Generally, a base structure according to the invention may comprise any structure on which the bowstring force measuring device according to the invention may be mounted, together with a bowstring displacement detecting device for those forms of the invention that utilize such a displacement detecting device.

Figure 4:
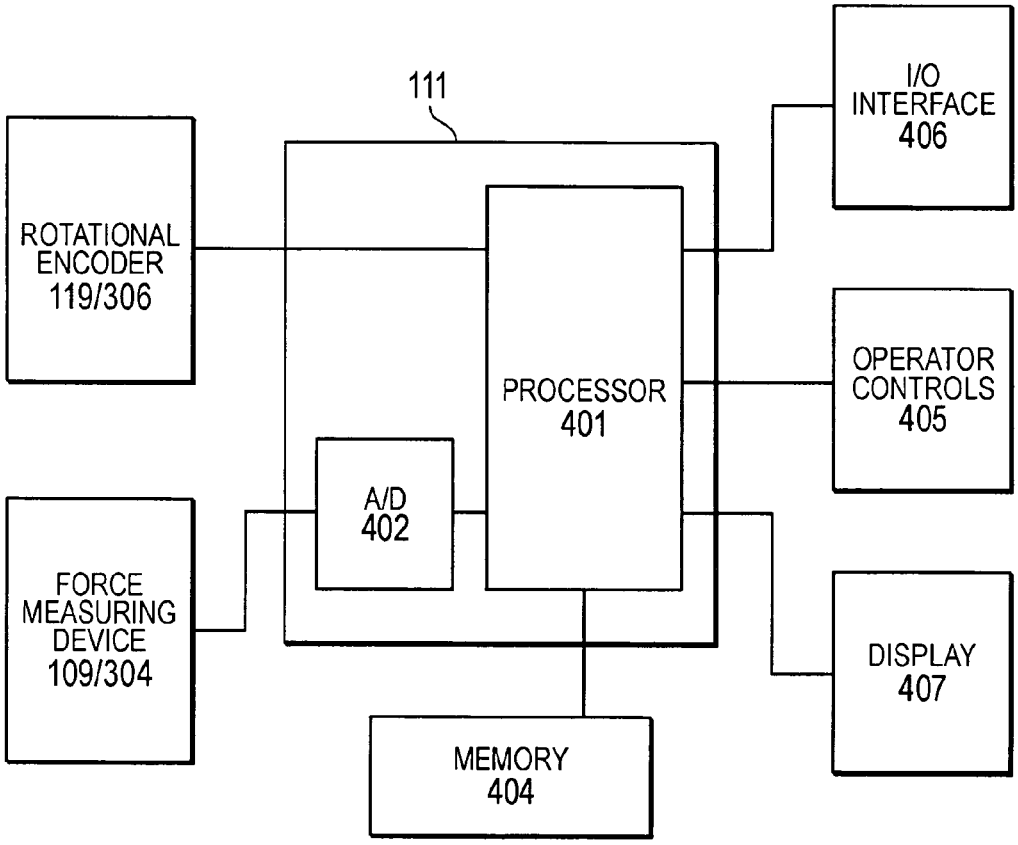
FIG. 4 is a block diagram illustrating the various components of a device embodying the principles of the invention.

Referring to FIG. 4, both the rotational encoder (119 in FIGS. 1 and 306 in FIG. 3) and force measuring device (109 in FIG. 1 and 304 in FIG. 3) provide their respective output signal to a processing device 111 which corresponds to the processing device 111 shown in FIG. 1. The illustrated processing device 111 includes a processor or controller 401 mounted on a single integrated circuit chip package with an analog-to-digital signal converter 402. This analog to digital signal converter 402 converts the analog force output signal from the force measuring device 109/309 into a digital signal for manipulation with processor 401. FIG. 4 also shows memory module 404 operatively connected to processing device 111. It will be appreciated that the memory used by processor 401 may be integrally formed on the same substrate as the processor or may be contained in the common package making up processing device 111. Even where memory for processor 401 is contained in the package making up processing device 111, forms of the invention may include additional memory modules or a socket for receiving additional memory modules similar to module 404 to enhance the capabilities of the device.

FIG. 4 also shows several input and/or output devices associated with processing device 111. In particular, a device according to the present invention may include display 407 (corresponding to display 307 in FIG. 3) for displaying information regarding the bowstring force characteristics, displaying the actual force-draw and/or let-down curves, or for displaying information regarding the operation, setup, or calibration of the device (100 in FIGS. 1 and 300 in FIG. 2). Various operator controls 405 may also be included to allow the user to input information or otherwise control the processing device 111. Such controls may include one or more buttons or switches, or a keypad for example. Preferred forms of the invention also include a separate input/output interface 406 such as a suitable serial connection that allows data to be communicated to and from the processing device 111. For example, input/output interface 406 may comprise a USB or other high speed serial interface, or perhaps an RS 232 interface that allows data collected and maintained by processing device 111 to be downloaded to another processing system such as a personal computer. Input/output interface 406 may also be used to upload data and operational program code for use by processing device 111.

It will be appreciated that FIG. 4 shows only the basic electronic components of a device according to the present invention. The figure omits power connections, a power supply, and power source in order to simplify the drawing and to avoid obscuring the present invention in unnecessary detail. Preferred forms of the invention will commonly include a battery as a power source and voltage conditioning circuitry for providing suitable power to the various components shown in FIG. 4 through suitable power connections. It will also be appreciated that processor 401 operates under the control of program code read from some memory to operatively communicate with the other system components shown in FIG. 4 and to produce the desired bowstring force result, whether that result is the identification of critical bowstring force characteristics over a draw cycle or simply the collection and recording of bowstring force data (and displacement data in some forms of the invention).

Figure 5:
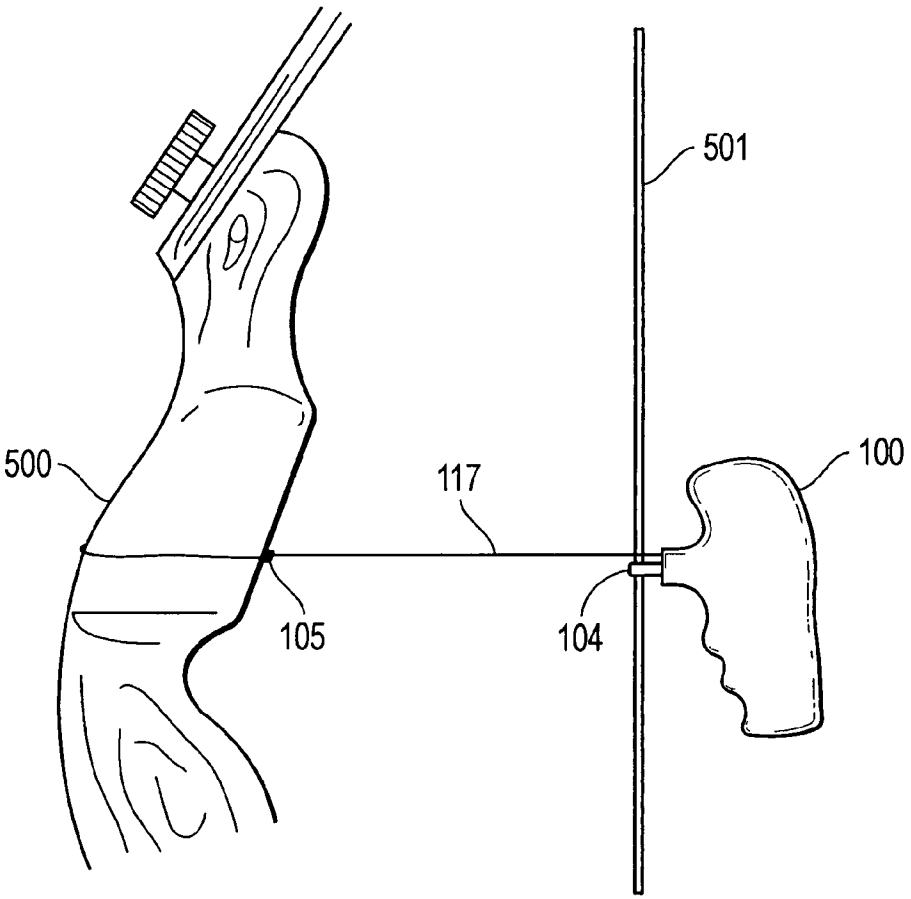
FIG. 5 is a representation of a device according to the invention connected in an operating position with the bow and bowstring in a relaxed position.
Figure 6:
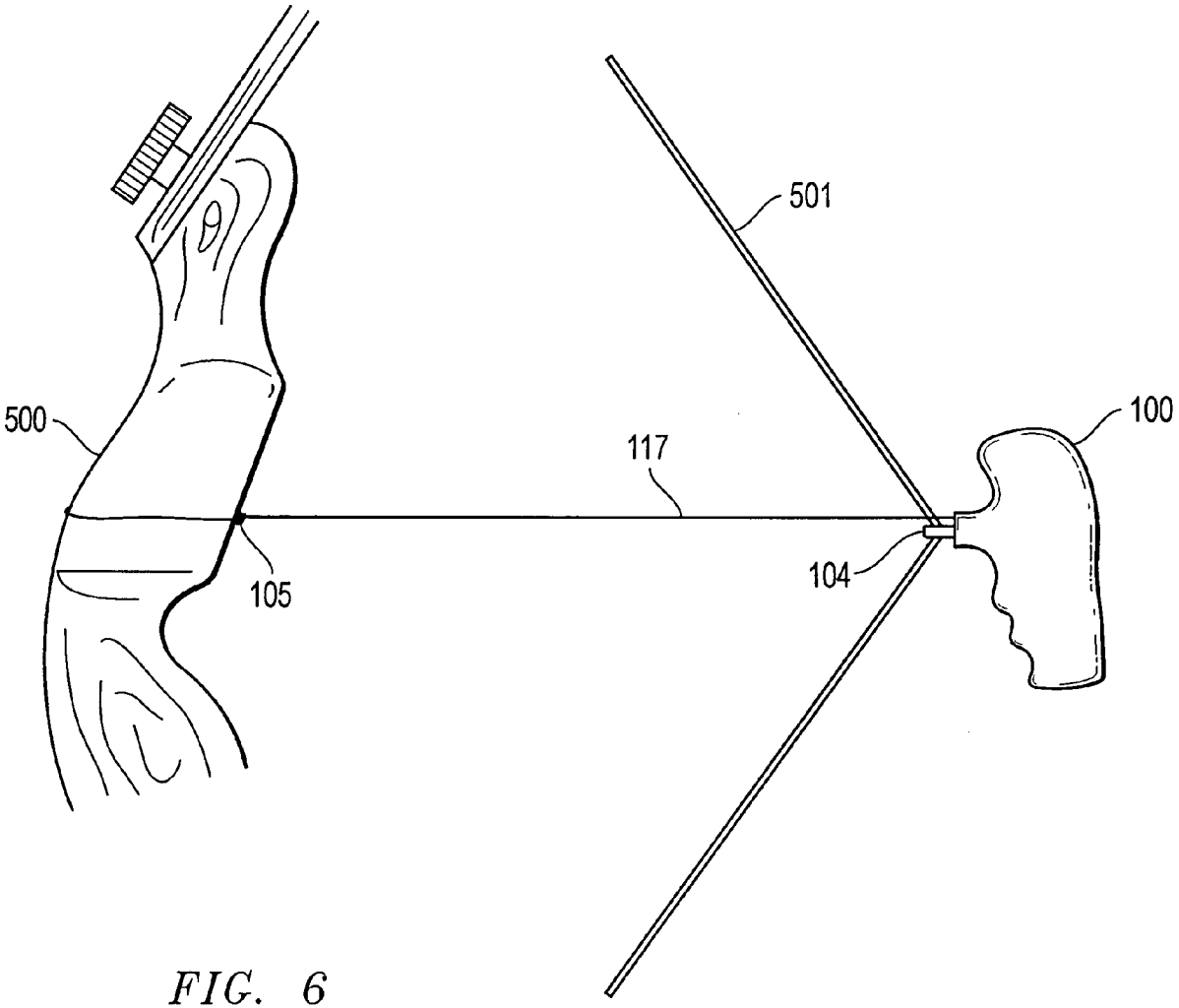
FIG. 6 is a representation similar to FIG. 5 but showing the bow and bowstring in a drawn position.

The operation of an apparatus embodying the principles of the invention and processes embodying the principles of the invention may now be described with reference to FIGS. 5 and 6 and to the hand grip-type device 100 shown in FIG. 1. FIG. 5 shows a hand grip-type device 100 (shown first in FIG. 1) connected to a bow 500 and bowstring 501 in a relaxed position at the start and end of the bowstring draw cycle. In this relaxed, starting position, device 100 is positioned with bowstring connector 104 hooked around to bowstring 501 and with displacement measuring line 117 extended outwardly and connected to bow 500 with bow connector 105. This particular bow connector 105 allows line 117 to be connected to bow 500 by hooking over the line after the line is wrapped around the bow. The slight spring tension applied by the supply or take-up reel 118 pulls line 117 to the right in the figure to hold line taught in this initial position.

From the position shown in FIG. 5, the user grasps bow 500 in one hand and device 100 in the other hand, and pulls device 100 to the right in the figure so as to draw bowstring 501 generally to the full draw position in which the bowstring would be released if the archer were releasing an arrow. This full draw position is shown in FIG. 6. The force measured by strain gauge 109 or other force measuring device used according to the invention results in a force output signal that is converted to a digital signal by analog-to-digital converter 402 shown in FIG. 4 and then may be sampled and recorded as desired between the position shown in FIG. 5 and the position shown in FIG. 6. The sampling rate should be set to provide a reasonable granularity of force data points between the two positions shown in FIGS. 5 and 6. The signal generated from the rotational encoder wheel 119 provides a signal from which the displacement of the bowstring with respect to the bow may be determined by processing device 111. From the position shown in FIG. 6, the user slowly releases the force on device 100 and this allows the device to return to the position shown in FIG. 5. The force data collected from the force measuring device 109 on this return portion of the bowstring draw cycle represents the force applied over the course of the let-down curve.

The raw data collected from force measuring device 109 may be used in a number of different ways to provide the desired bowstring force plotting or bowstring force information. In one preferred form of the invention the digitized signal from strain gauge 109 and analog-to-digital signal converter is read periodically and then stored in memory. In this preferred form of the invention, processor 401 analyzes pulses from rotational encoder wheel 119 to provide an indication of the distance that bowstring 501 is displaced from the initial position shown in FIG. 5. Processor 401 may simply record this displacement data in memory together with the corresponding bowstring force data at that time. The resulting data may be plotted manually to produce a bowstring force-draw curve or may be processed with processor 401 or a suitable external processing device to produce a force-draw curve that may be displayed or printed. The recorded force and displacement data may also be analyzed under the control of suitable program code to identify certain bowstring force characteristics such as maximum pull weight, maximum let-off, and percent let-off. Processor 401 may include the capability and programming to identify these characteristics or the raw data may be downloaded to another processing device such as a personal computer which is programmed to identify the desired bowstring force characteristics.

According to one preferred form of the invention, several important or critical bowstring force characteristics may be detected by device 100 even without using a bowstring displacement detecting arrangement 112 or with the bowstring displacement detecting arrangement omitted from the device. For example, with just the bowstring force measuring device 109, preferred forms of the invention may detect peak pull weight by instructing processor 401 to read the digitized force data at a suitable sampling rate and to store the highest force read during the bowstring draw cycle. This may be accomplished by comparing each force read from the force measuring device with the highest force value previously recorded over the draw and storing the higher value in a register or other memory location. Regardless of how processor 401 identifies the highest force over the draw, the highest detected force will comprise the peak pull weight. Other points along the draw-force curve may be detected or identified by observing the various readings recorded by the force measuring device. For example, maximum let-off force may be determined by continually sampling the force after the recorded peak or maximum pull weight and storing the lowest pull weight after the recorded peak. This lowest pull weight after the peak may be subtracted from the peak pull weight to produce the let-off. This let-off determination may be made more accurate by only considering force values that have declined over a certain amount, 25% for example, as compared to the peak pull weight before the force readings again begin to rise which indicates that the bowstring is being returned from the maximum displacement to the relaxed position. Once the peak pull weight and let-off are undetermined, the let-off may be calculated and displayed to the user directly or as a percentage of the peak pull weight.

Other procedures may be used according to the invention to determine let-off without bowstring position information. In one alternate procedure, the peak pull weight is identified as described in the preceding paragraph and the user is instructed to hold a full draw position for a certain period of time or until the device according to the invention emits some signal such as an audible signal through a suitable audible signal generating element included in device 100. In this process, the pull weight measured by force measuring device 109 while the user holds the bowstring at the full draw position is considered the full draw weight, and let-off is determined by subtracting the full draw weight from the maximum pull weight.

All of these important or critical bowstring force characteristics, the peak pull weight, full draw weight, let-off, and percentage let-off may be displayed to the user using a suitable display device such as display 407 in FIG. 4. The display device may be positioned at a suitable location on the device according to the invention such as on the wrist strap 302 as indicated by display 307 in FIG. 3. In the hand grip form of invention shown in FIG. 1, the display device may be positioned in the side of the housing 101, on the top of the housing, or any other suitable location. In some forms of the invention it may be desirable to have a display located remotely from the data collection portion of the device and receive display information with a wired or wireless link to the data collection portion of the device.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. An apparatus including:

(a) a base structure;

(b) a force measuring device operatively connected between a bowstring connector and a force transmitting connection to the base structure, the force measuring device for producing a force output signal indicative of the tensile force applied along a draw force axis between the bowstring connector and the force transmitting connection to the base structure; and (c) a processing device mounted on the base structure for receiving the force output signal from the force measuring device and for identifying one or more bowstring force characteristics from the force output signal produced over the course of the bowstring draw cycle.

2. The apparatus of claim 1 wherein the force transmitting connection comprises a pivot connection.

3. The apparatus of claim 1 wherein identifying one or more bowstring force characteristics includes identifying a peak pull weight comprising a highest force value indicated by the force output signal over the course of the bowstring draw cycle.

4. The apparatus of claim 1 wherein identifying one or more bowstring force characteristics includes identifying a let-off force comprising the difference between a maximum force value indicated by the force output signal over course of the bowstring draw cycle and a lowest force value indicated by the force output signal over the course the bowstring draw cycle after the maximum force value and before a full draw position.

5. The apparatus of claim 4 wherein the processing device is also for calculating a percent let-off value from the let-off force and the maximum force value.

6. The apparatus of claim 1 further including a displacement detecting device mounted on the base structure, the displacement detecting arrangement for connecting to a bow and producing a bowstring displacement output signal as the base structure is moved with respect to the bow in the course of the bowstring draw cycle, and wherein the processing device is also for receiving the bowstring displacement output signal from the displacement detecting device, and for maintaining a record of bowstring displacement over the bowstring draw cycle.

7. The apparatus of claim 1 further including a display device mounted on the base structure, and wherein the processing device is also for controlling the display device.

8. An apparatus including:

(a) a base structure;

(b) a force measuring device operatively connected between a bowstring connector and a force transmitting connection to the base structure, the force measuring device for producing a force output signal indicative of the tensile force applied along a draw force axis between the bowstring connector and the force transmitting connection to the base structure;

(c) a displacement detecting device mounted on the base structure, the displacement detecting device for connecting to a bow and producing a bowstring displacement output signal as the base structure is moved with respect to the bow in the course of a bowstring draw cycle; and (d) a processing device for receiving the force output signal from the force measuring device, for receiving the bowstring displacement output signal from the displacement detecting device, for maintaining a record of the tensile force applied along the draw force axis over the bowstring draw cycle, and for maintaining a record of bowstring displacement over the bowstring draw cycle.

9. The apparatus of claim 8 wherein the force transmitting connection comprises a pivot connection.

10. The apparatus of claim 8 further including a display device mounted on the base structure, and wherein the processing device is also for controlling the display device.

11. The apparatus of claim 8 wherein the displacement detecting device includes a displacement line in operative contact to drive a rotational encoder.

12. A method for use with an archery bow and associated bowstring, the method including the steps of:

(a) connecting a base structure to the bowstring through a force measuring device;

(b) moving the base structure with respect to the bow to displace the bowstring through a bowstring draw cycle;

(c) detecting the force applied between the bowstring and base structure at least periodically over the course of displacing the bowstring through the bowstring draw cycle; and (d) identifying one or more bowstring force characteristics from the detected force applied between the base structure and the bowstring over the course of the bowstring draw cycle.

13. The method of claim 12 wherein moving the base structure with respect to the bow to displace the bowstring through the bowstring draw cycle includes grasping the bow with one hand and pulling the base structure with the opposite hand.

14. The method of claim 12 wherein the step of identifying one or more bowstring force characteristics includes identifying a peak pull weight comprising a highest force value between the bowstring and the base structure detected over the course of the bowstring draw cycle.

15. The method of claim 12 wherein the step of identifying one or more bowstring force characteristics includes identifying a let-off force comprising the difference between a maximum force value detected between the bowstring and the base structure over the course of the bowstring draw cycle and a lowest force value detected between the bowstring and base structure over the course of the bowstring draw cycle after the maximum force value and before a full draw position.

16. The method of claim 12 further including the step of displaying one or more of the bowstring force characteristics on a display mounted on the base structure.

17. A method for use with an archery bow and associated bowstring, the method including the steps of:

(a) connecting a base structure to the bowstring through a force measuring device and connecting the base structure to the bow through a displacement measuring device;

(b) moving the base structure with respect to the bow to displace the bowstring through a bowstring draw cycle;

(c) maintaining a record of the force applied between the base structure and the bowstring while displacing the bowstring through the bowstring draw cycle; and (d) maintaining a record of bowstring displacement over the bowstring draw cycle.

18. The method of claim 17 wherein moving the base structure with respect to the bow to displace the bowstring through the bowstring draw cycle includes grasping the bow with one hand and pulling the base structure with the opposite hand.

19. The method of claim 17 further including the step of displaying a bowstring force characteristic on a display mounted on the base structure.

20. The method of claim 17 further including the step of calculating a percent let-off value and displaying the percent let-off value on a display mounted on the base structure.

* * * * *

UNITED STATES PATENT AND TRADEMARK OFFICE

CERTIFICATE OF CORRECTION

PATENT NO. : 7,086,298 B1
APPLICATION NO. : 10/921446
DATED : August 8, 2006
INVENTOR(S) : Ronin Borg Colman It is certified that error appears in the above-identified patent and that said Letters Patent is hereby corrected as shown below:

At column 8, line 42:
Change "of the" to --of a--.

Signed and Sealed this

Fifth Day of December, 2006

JON W. DUDAS
*Director of the United States Patent and Trademark Office*